US005150165A

United States Patent [19]

Asai

[11] Patent Number: 5,150,165

[45] Date of Patent: Sep. 22, 1992

[54] IMAGE FORMING APPARATUS HAVING IMAGE TRANSFER MEMBER

[75] Inventor: Jun Asai, Tokyo, Japan

[73] Assignee: Canon Kabushiki Kaisha, Tokyo, Japan

[21] Appl. No.: 682,676

[22] Filed: Apr. 9, 1991

[30] Foreign Application Priority Data

Apr. 10, 1990 [JP] Japan ..... 2-93054

[51] Int. Cl.[5] ..... G03G 15/16

[52] U.S. Cl. ..... 355/274; 355/271

[58] Field of Search ..... 355/271, 273, 274, 275, 355/277, 219; 29/132, 130

[56] References Cited

U.S. PATENT DOCUMENTS

| | | | |
|---|---|---|---|
| 3,702,482 | 11/1972 | Dolcimascolo et al. | 355/271 X |
| 3,920,325 | 11/1975 | Swift | 355/271 |
| 3,924,943 | 12/1975 | Fletcher | 355/274 |
| 4,039,803 | 1/1982 | Blazak | 355/271 X |
| 4,382,673 | 5/1983 | Nakajima et al. | 355/274 |
| 4,674,860 | 6/1987 | Tokunaga et al. | 355/274 |
| 4,959,688 | 9/1990 | Koitabashi | 355/219 |
| 4,967,231 | 10/1990 | Hosoya et al. | 355/219 |
| 5,010,370 | 4/1991 | Araya et al. | 355/274 |
| 5,098,851 | 2/1992 | Tanaka et al. | 355/219 |

FOREIGN PATENT DOCUMENTS

| | | | |
|---|---|---|---|
| 51-9840 | 1/1976 | Japan . | |
| 51-59636 | 5/1976 | Japan . | |
| 0246773 | 10/1988 | Japan . | |
| 0172986 | 7/1989 | Japan | 355/275 |
| 0292385 | 11/1989 | Japan . | |

OTHER PUBLICATIONS

Fink et al, Standard Handbook for Electrical Engineers, p. 4–170.

*Primary Examiner*—A. T. Grimley
*Assistant Examiner*—Robert Beatty
*Attorney, Agent, or Firm*—Fitzpatrick, Cella Harper & Scinto

[57] ABSTRACT

An image forming apparatus having an image bearing member and an image transfer charger for transferring a toner image from the image bearing member onto a transfer material. The transfer charger has a transfer member contactable to the backside of the transfer material. The transfer member includes a conductive base, and a surface layer outside the eleastic layer. The transfer member's characteristics fall within the parameters of:

$$5\times10^{7}\leqq R_2\leqq5\times10^{10}\text{ (ohm.cm), and}$$

$$R_1d_1/R_2d_2\geqq10$$

where $r_1$ is a volume resistivity of the elastic layer, $d_1$ is a thickness of the elastic layer, $R_2$ is a volume resistivity of the surface layer, and $d_2$ is a thickness of the surface layer.

14 Claims, 2 Drawing Sheets

IMAGE FORMING APPARATUS HAVING IMAGE TRANSFER MEMBER

FIELD OF THE INVENTION AND RELATED ART

The present invention relates to an image forming apparatus such as an electrophotographic apparatus or electrostatic recording apparatus which has image transfer means for transferring an image from an image bearing member to a transfer material.

In a known image forming apparatus wherein a transferable toner image is formed on a surface of an image bearing member and is electrostatically transferred onto a transfer material such as paper, a contact type image transfer member in the form of an elastic transfer roller or the like is contacted to the image bearing member which is rotating, at an image transfer position.

To the transfer position, the transfer material is supplied in timed relation with the toner image (charged toner) on the surface of the image bearing member, and simultaneously, a transfer bias voltage having a polarity opposite to that of the toner is applied to the transfer member to form an image transfer electric field, which is effective to transfer the toner image from the image bearing member onto the transfer material.

In such an apparatus, it is preferred in order to provide good image transfer property that the image transfer current supplied during the transfer operation is within a predetermined range. If the current is too small, the charge of the toner transferred onto the transfer material is also small with the result that the toner scatters upon separation of the transfer material from the image bearing member (photosensitive member). If, on the contrary, the current is too large, the toner constituting the image is attracted to the background area of the image during the image transfer action with the result of spread of the image, thus deteriorating the quality of the image. The paper which is most frequently used as the transfer material has an electric resistance which significantly changes by 4–5 orders due to ambient humidity In order to reduce the scattering of the image or the spread of the image, the transfer roller or another transfer member is not made electrically conductive but is given a substantial resistivity. More particularly, where the process speed which is the moving speed of the peripheral of the image bearing member is 60 mm/sec, and the thickness of the transfer roller measured from the surface of the core metal to the surface of the roller is 6 mm, the transfer member is made of such a material having a volume resistivity of not less than $5\times10^{10}$ ohm.cm upon 1 KV application to the transfer member.

However, if the large volume resistivity material is used, the voltage applied to the transfer roller is necessarily required to be higher in order to obtain the predetermined current. This results in the requirements for a high voltage source and peripheral mechanisms therearound which lead to bulky device and increase in the cost. Assuming that the upper limit of the applied voltage is approximately 5–6 KV, the volume resistivity of the transfer roller is required to be not more than $5\times10^{12}$ ohm.cm when the process speed is 60 mm/sec, and the thickness of the transfer roller is approximately 6 mm. As a result, the usable range of the volume resistivity is as small as $5\times10^{10}$–$5\times10^{12}$ ohm.cm The above deals with a single layer structure roller having a single layer on the core metal.

In the case of a multi-layer structure roller, the volume resistivity discussed above should be replaced by the resistance between the core metal and the surface layer of the roller. Therefore, the usable range in the case of the multi-structure roller is as small as two orders of the resistance between the core metal and the roller surface layer. Where the process speed and/or the thickness of the roller is different, the absolute value of the usable resistance is different, but the usable range is still required to be within the two orders.

In consideration of the above, a transfer roller is made of foamed EPDM (tercopolymer of ethylene propylenediene) in which electrically conductive or semiconductor filler materials are dispersed to adjust its hardness and volume resistivity.

The EPDM has a small resistivity change against ambience, particularly humidity An example of measurements shows $6\times10^{11}$ ohm.cm after it is kept for a week under low temperature and low humidity conditions (15° C., 10%RH) and $3\times10^{11}$ ohm.cm after it is kept for a week under high temperature and high humidity conditions (32.5° C. and 90%RH).

However, if the transfer roller is made of the EPDM sponge coated on a core metal of iron, aluminum or the like (single layer structure), the following problems arise.

When a contactable type transfer member such as the transfer roller is used, and when a width of an original to be copied is larger than the transfer material or when a thick original such as book is to be copied, the area outside the width is developed into a solid black toner image, and therefore, the solid black image toner is directly contacted to the transfer roller. This may contaminate the backside of the subsequent transfer material or materials, or scatters within the apparatus to contaminate various parts.

An attempt to provide a solution to the problems, Japanese Laid-Open Patent Application No. 9840/1976, for example, proposes that when the transfer material is absent from the transfer position where the image bearing member and the transfer roller are contacted to each other, the transfer roller is supplied with a bias voltage having the same polarity has the toner so that the toner deposited on the transfer roller is returned to the image bearing member (transfer roller cleaning means) However, with the single layer structure transfer roller, the cleaning means sometimes does not function satisfactorily. This will be described in detail As described, the transfer roller is supplied with the cleaning bias voltage when the transfer material is absent from the transfer position At this time, electric discharge occurs between the image bearing member and the transfer roller, and the resultant electric field is effective to return a part of the toner on the transfer roller to the image bearing member. However, the rest of the toner acquires the electric charge resulted from the ionization of the air by the discharging. The toner is charged to the polarity opposite to that of usual toner and is deposited on the transfer roller. Sooner or later, the transfer material comes to the transfer position When the transfer bias is applied, the toner oppositely charged by the cleaning bias, that is, the toner charged to the same polarity as the transfer voltage, receives the force away from the transfer roller by the transfer electric field with the result of scattering or toner contamination of the backside of the subsequent transfer material.

If the EPDM sponge roller is used with the single layer structure, the volume resistivity adjacent the surface thereof is also $5\times10^{10}$–$5\times10^{12}$ ohm.cm. Therefore, when the roller is supplied with the cleaning bias, the toner tends to be charged to the opposite polarity, that is, opposite to the normal charging polarity. For this reason, even if the cleaning bias is applied to the transfer roller when the transfer material is absent from the transfer position, the roller is not cleaned satisfactorily.

U.S. Pat. No. 3,702,482 discloses that in order to improve the toner releasing property and in order not to increase the hardness of the roller, the transfer roller comprises a conductive core metal, an elastic layer having a volume resistivity of $10^9$–$10^{10}$ ohm.cm thereon and a releasing layer having a volume resistivity of $10^{13}$–$10^{15}$ ohm.cm thereon. This, however, has a high resistivity of the outer layer, and therefore, is not free from the problem with the EPDM sponge. In addition, the volume resistivity of the layer is larger than that of the inner layer, and therefore, when the resistance of the outer layer is greatly dependent on the humidity, the entire resistance of the roller varies significantly. Accordingly, it is difficult to provide good image transfer.

In consideration of the above, Japanese Laid-Open Patent Application No. 59636/1976 proposes that the transfer roller is coated with a material having low moisture transmitting property to reduce the resistance change due to the moisture change. However, this is still unsatisfactory to prevent scattering of the toner, contamination of the backside of the transfer material and local non-transfer which may be caused by the toner charged to the polarity opposite from the normal polarity due to abnormal discharging at the transfer station particularly when the transfer material is dry paper.

SUMMARY OF THE INVENTION

Accordingly, it is a principal object of the present invention to provide an image forming apparatus wherein the change of the resistivity of the transfer member due to humidity change is minimized.

It is another object of the present invention to provide an image forming apparatus wherein the size and cost of a power source for the transfer member is reduced.

It is a further object of the present invention to provide an image forming apparatus wherein the toner scattering and the contamination of the backside of the transfer material is prevented.

It is a further object of the present invention to provide an image forming apparatus wherein local non-transfer of the image can be prevented even if the transfer material is dry paper.

It is a yet further object of the present invention to provide an image forming apparatus having good image transfer properties.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
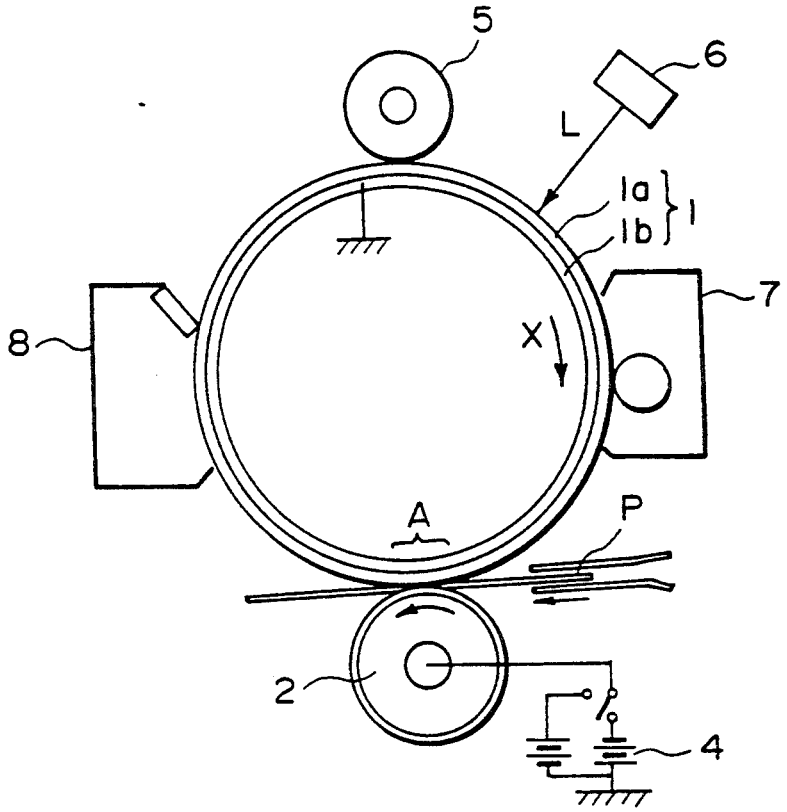
FIG. 1 is a side view of an image forming apparatus according to an embodiment of the present invention.

Referring to FIG. 1, there is shown an electrophotographic copying machine as an exemplary image forming apparatus according to an embodiment of the present invention An image bearing member is in the form of a cylindrical photosensitive member 1 comprising a grounded conductive base member 1*a* made of aluminum, steel or the like and an organic photoconductive layer 1*b* as a photosensitive layer. It is rotatable in a direction indicated by an arrow X. The organic photoconductive layer has a negative charging property. The photosensitive member 1 rotates in the direction X and is uniformly charged to a negative polarity by a charging roller 5, and is exposed to light L through an optical system 6, so that an electrostatic latent image is formed. The light L is the light reflected by an original on an original supporting platen (not shown). The electrostatic latent image formed on the photosensitive member is developed by regular development with the toner charged to the positive polarity by the developing device 7 into a toner image when the toner image reaches an image transfer position where a transfer roller (transfer member) 2 is contacted to the photosensitive member 1 to form a nip, a transfer material P (paper) is supplied to the transfer position A in synchronism therewith. When the transfer material P is present at the transfer position A, the transfer material P is moved by the rotation of the transfer roller 2, and the transfer roller 2 is supplied from a power source 4 with a transfer bias voltage, by which the toner image is transferred from the photosensitive member 1 onto the transfer material P. The transfer bias voltage is of a polarity opposite to the charging polarity of the toner during the development, that is, it is of negative polarity When the transfer material P is not present at the transfer position A, the transfer roller 2 is supplied from the power source 4 with a cleaning bias voltage having a polarity which is the same as the charging polarity of the toner during the development, that is, the positive polarity. By doing so, an electric field is formed to return the toner deposited on the transfer roller 2 to the photosensitive member 1, so that the transfer roller 2 is cleaned. The duration of the cleaning bias voltage application to the transfer roller 2 may be a part of the duration in which the transfer material is not present at the transfer position A.

The transfer material P, after being subjected to the transfer operation, is separated from the photosensitive member 1 and is conveyed to an unshown image fixing position where the toner image is fixed on the transfer material P. The residual toner remaining on the photosensitive member 1 after the image transfer is removed by a cleaning device 8, so that the photosensitive member 1 is prepared for the next image forming operation.

Figure 2:
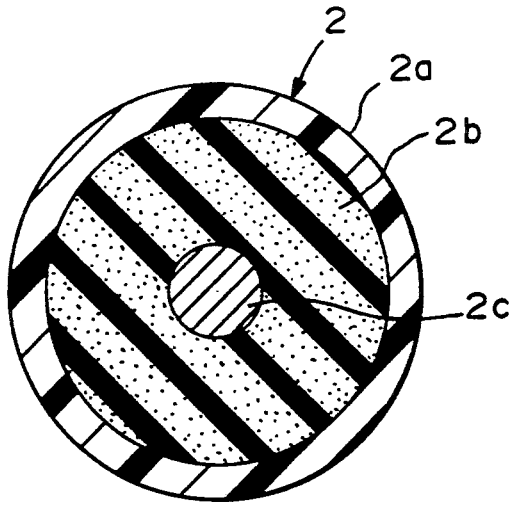
FIG. 2 is a sectional view of a transfer roller used in the image forming apparatus of FIG. 1.

Referring to FIG. 2, the description will be made as to the transfer roller (transfer member) 2. As shown in FIG. 2, the transfer roller 2 comprises a core metal 2*c* as the conductive base, a semiconductive elastic layer 2*b* outside thereof (closer to the photosensitive member 1) and a semiconductor coating layer 2a as a surface layer (further closer to the photosensitive member 1). The elastic layer 2b is mainly of the foamed EPDM having the following composition.

| Materials | part by weight |
|---|---|
| EPDM | 100 |
| ZnO | 10 |
| Zinc stearate | 2 |
| Vulcanization accelerator | 3 |
| Foaming agent | 10 |
| Conductive carbon | 23 |
| Paraffin oil | 45 |
| Reinforcing carbon | 20 |

The above materials are uniformly dispersed and kneaded and is wrapped around the conductive core metal having a diameter of 8 mm and coated with primer. It is placed in a metal mold to be preformed at 40° C. and 100 kgf/cm$^2$. It is then vapor-vulcanized at 160° C. for 30 min, and thereafter, is polished or machined into a roller having a diameter of 20 mm (thickness of 6 mm) and a length of 230 mm.

The resistivity of the roller was measured in the following manner. A conductive rubber sheet ($10^1$–$10^2$ ohm.cm) having a width of 10 mm and a thickness of 0.1 mm is wrapped on the roller, and a voltage of 1 KV is applied between the core metal and the conductive rubber sheet, and the resistance is measured, which is then converted to a volume resistivity.

The volume resistivity of the roller measured in the above-described manner as $5\times10^{11}$ ohm.cm after the roller is left under the normal temperature and normal humidity condition (23° C. and 60%RH) for one weak.

Figure 3:
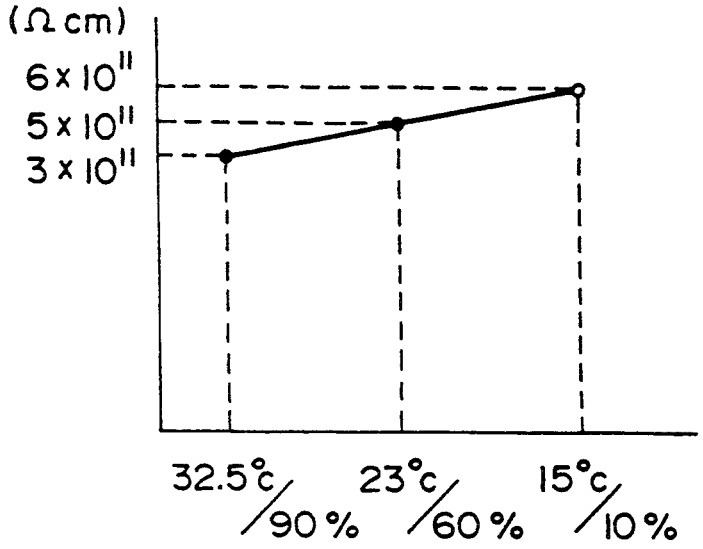
FIG. 3 is a graph showing a change of the volume resistivity of a foamed EPDM elastic layer due to ambient condition change.

FIG. 3 shows a variation of the resistance due to the humidity. The variation rate k $=\log(R_L/R_H)$ is 0.3, where $R_H$ is the resistance under the high temperature and high humidity condition (32.5° C. and 90%RH), and $R_L$ is the resistance under the low temperature and low humidity condition (15° C. and 10%RH). The duration in which the roller is left under each of the conditions was 5–7 days.

As described hereinbefore, the proper resistivity of the transfer roller is dependent on the process speed of the image bearing member and the thickness of the roller which are influential to the image transfer property and to the size of the power source for the image transfer, but the range of the proper resistance is approximately two orders. If the transfer roller has a smaller resistance than the proper range, the improper image transfer including toner scattering occurs. If it is larger than that, the size of the transfer power source and the cost thereof are increased.

On the other hand, the resistance unavoidably varies due to manufacturing tolerances in approximately one order. Therefore, in order to limit the resistivity of the produced rollers within the proper range, it is desirable that the resistivity change due to the ambient variation is limited within one order. In other words, $R_L/R_H \leqq 10$, or variation ratio k $\leqq 1$.

The following table gives the variation ratio k when the elastic layer 2b is of materials other than EPDM, when the resistivities thereof were adjusted so as to have the same resistivity as the EPDM roller and the normal temperature and normal humidity condition.

| Materials | Urethane (foam) | Cr (foam) | NBR (foam) |
|---|---|---|---|
| k | 2.5 | 2.4 | 1.5 |

As will be understood from the above Table, the variation ratio k is clearly larger than that of EPDM (k=0.3). Actually, they involved the problems of low quality images and bulky power source for the image transfer.

There is a difference in the molecular structure between EPDM and the other materials in that the EPDM does not have hydrophilic group, whereas the other materials have it.

The present invention takes not only the advantages of the EPDM of the durability against ozone, the durability against heat and the durability against acid/alkali but also the lack of the hydrophilic group which leads to the durability against water.

The description will be made as to the semiconductive coating layer 2a. The roller manufactured in the manner described above is dipped in the following solvent:

| | |
|---|---|
| alcohol/soluble nylon/ | 15 parts by weight |
| conductive carbon | 2.5 parts by weight |
| methanol | 80 parts by weight |

The roller thus applied is dried. Then, the volume resistivity was $1\times10^9$ ohm.cm.

Figure 4:
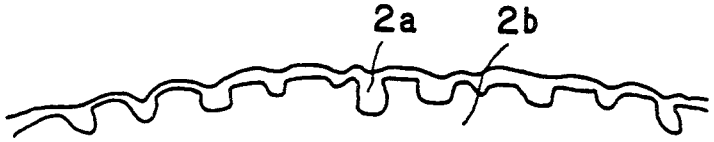
FIG. 4 is an enlarge side view of a surface layer of the transfer roller.

FIG. 4 is a partial enlarged sectional view of the roller thus produced The average thickness of the coating layer 2a is approximately 30 microns.

The resistance variation of only of the coating layer due to the humidity is larger than that of the EPDM, and the variation ratio k was approximately 2.3 under the same leading conditions.

Figure 5:
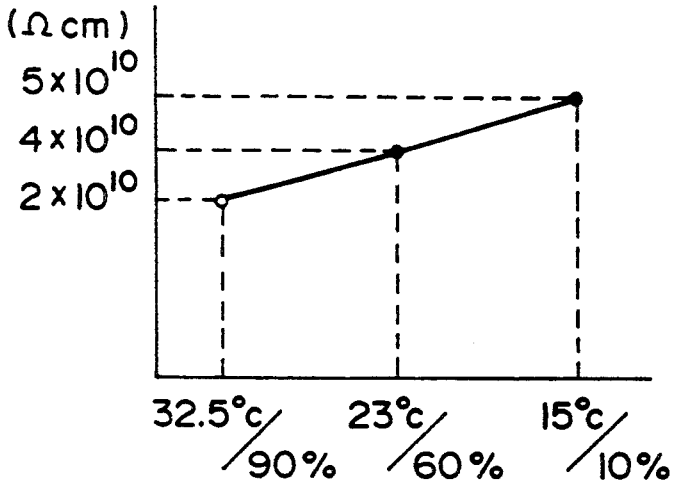
FIG. 5 is a graph showing a volume resistivity change of the transfer roller due to the ambient condition.

However, the thickness of the coating layer 2a is very small as compared with the thickness of the elastic layer 2b, the variation ratio k as the entirety of the transfer roller due to the ambient condition change is approximately 0.4 ($R_L/R_H=2.5$), as shown in FIG. 5.

The experiments using the apparatus of FIG. 1 will be described. The diameter of the photosensitive member 1 was 60 mm, and the process speed of the copying machine (peripheral speed of the photosensitive member 1) as 60 mm/sec.

As described hereinbefore, the photosensitive member 1 included the OPC photosensitive layer. It was uniformly charged to the negative polarity, and the toner was positively charged. The voltage applied from the voltage source 4 to the transfer roller 2 was −4.5 KV when the transfer material P is present at the transfer position, and was +1.5 KV when the transfer material is not at the transfer position.

The used transfer material was dried paper which has been left under the low temperature and low humidity condition. Line images, solid black images and halftone images were produced, and it was confirmed that all of such images were sharp and clear without local non-transfer.

Transfer material of A4 size was longitudinally fed, and an original was A4 size having solid black image on its whole surface The transfer bias polarities were switched in the manner described above between the transfer period and the non-transfer period. Continuously 50 copies were produced. Thereafter, one A4 size transfer material was fed to check the backside contamination of the transfer material. It was confirmed that the backside contamination was not observed.

Also, after 50 sheets were processed, the contamination of the metal transfer guide 3 supplied with −500 V was checked, and it was confirmed that the contamination was practically negligible.

The content of the conductive carbon contained in the semiconductive coating layer 2a was changed to change the volume resistivity between $1\times10^5$–$1\times10^{13}$ ohm.cm, and the white dots (non-transfer) and the backside contamination of the transfer material were checked. The results were as follows:

| Vol. resistivity of coating layer 2a (ohm.cm) | White dots | Backside contamination |
|---|---|---|
| $1\times10^5$ | Y | N |
| $1\times10^6$ | P | N |
| $5\times10^7$ | N | N |
| $5\times10^8$ | N | N |
| $5\times10^9$ | N | N |
| $5\times10^{10}$ | N | N |
| $5\times10^{11}$ | N | P |
| $5\times10^{12}$ | N | Y |
| $5\times10^{13}$ | N | Y |

N: The white dots or the backside contaminations were hardly seen.
Y: Many white dots and backside contaminations were seen.
P: The white dots and backside contaminations were partly seen.

From the above, it is understood that either the white dots or backside contamination does not appear when the volume resistivity of the coating layer is $5\times10^7$–$5\times10^{10}$ ohm.cm.

In order to provide a roller having a less variable resistivity as a whole when the roller comprises a semiconductive elastic layer of EPDM exhibiting less resistivity variation and a semiconductive coating having larger resistivity variation, the resistivity of the coating layer is desirably non-influential to the resistivity of the entirety of the roller.

The resistivity of the elastic layer is expressed as $R_1d_1\times\alpha$, and that of the coating layer is $R_2d_2\times\alpha$, where $R_1$ is the volume resistivity of the semiconductive elastic layer (ohm.cm); $d_1$ is a thickness thereof (cm); $R_2$ is the volume resistivity of the coating layer (ohm.cm); $d_2$ is a thickness thereof (cm); and $\alpha$ is constant.

In order that the resistance of the coating layer is substantially non-influential to the entire resistance, $$R_1d_2\times\alpha >> R_2d_2\times\alpha.$$

Resistance variation ratios k were measured for the rollers having different ratios of $R_1d_1/R_2d_2$. The results are:

| $R_1d_1/R_2d_2$ | k |
|---|---|
| $10^{-3}$ | |
| $10^{-2}$ | 4.2 |
| $10^{-1}$ | 4.2 |
| 1 | 4.2 |
| 5 | 4.0 |
| 10 | 1 |
| 50 | 0.35 |
| $10^2$ | 0.35 |
| $10^3$ | 0.35 |

As described hereinbefore, the range of the proper resistance of the entire transfer roller is as load as two orders, and in consideration of the unavoidable manufacturing tolerances, the variation ratio k is desirably not more than 1.

Therefore, for the purpose of stabilization of the resistance of the transfer roller, $$R_1d_1/R_2/d_2 \geqq 10$$

is desirable. In addition, the semiconductive elastic layer of EPDM is preferably has the volume resistivity of $5\times10^{10}$–$5\times10^{13}$ ohm.cm. Another embodiment of the transfer roller will be described. The core metal and the semiconductive elastic layer are the same as those described in conjunction with FIG. 2. A composite (trade name: ELECTRODUCK, available from Nihon Achison Kabushiki Kaisha, Japan) comprising conductive pigments of carbon black with binder of acrylic resin material solved in industrial thinner was used. The semiconductive elastic layer described in conjunction with FIG. 2 is dipped therein to produce the transfer roller.

The volume resistivity of the semiconductive coating layer was $1\times10^9$ ohm.cm, and the thickness was approximately 35 microns on the average.

The resistance change of the roller due to the humidity was 0.35 (=k). It will be understood that it is very stable as compared with the variation ratio of approximately 4.2 (=k) of the coating layer itself. It was confirmed that the scattering of the toner and the contamination of the transfer material was negligibly small from practical standpoint, and that the image quality was not deteriorated.

A further embodiment of the transfer roller will be described. The core metal and the inner semiconductive elastic layer were the same as described above. Semiconductive sheet having a thickness of 100 microns and produced by applying conductivity to PET (polyethylene terephthalate) by combining ion conductive molecules in the chain of the molecules thereof was used to coat the elastic layer surface wit a binder therebetween to form a transfer roller.

The volume resistivity of the sheet was $5\times10^9$ ohm.cm under the normal temperature and normal humidity condition (23° C. and 60%RH), and the variation ratio of the sheet itself was approximately 2.1 (=k), but the variation ratio as a whole of the roller was 0.35 (=k). Therefore, the image transfer properties were stable against the humidity change without toner scattering and backside contamination of the transfer material and without the deterioration of the image quality A further embodiment of the transfer roller will be described. The core metal and the semiconductive elastic layer were the same as the foregoing embodiments. As for the semiconductive coating layer, PFA (perfluoroalkoxy) resin was added with 8.2% by weight of carbon black and was formed into the thermal shrinkage tube by a biaxial stretching extruction It was used to coat the elastic layer with conductive bonding agent therebetween.

The volume resistivity of the tube was $1\times10^9$ ohm.cm under the normal temperature and normal humidity condition (23° C. and 60%RH). The variation ratio thereof was approximately 0.2 (=k), and the variation ratio of the entirety of the roller was as small as approximately 0.3 (=k). The toner scattering, the backside contamination of the transfer material and the degradation of the image quality were all negligibly small from the practical standpoint.

Further embodiment will be described. The core metal and the semiconductive elastic layer were the same as the foregoing embodiments As for the semiconductive coating layer, a coating composite of water emulsion (trade name: EMLOLON 345, available from Nihon Achison Kabushiki Kaisha) comprising polyurethane polymer combination, PTFE (polytetrafluoroethylene) and carbon black is applied on the elastic layer by dipping, and thereafter it is heat-cured at 120° C.–150° C. for 10–20 min. The average thickness of the coating layer was approximately 30 microns. The volume resistivity of the coating layer was $1\times10^9$ ohm.cm under the normal temperature and normal humidity condition. The variation ratio k thereof was approximately 4.0, but the variation ratio of the entirety of the roller was 0.35 (=k). Stabilized image transfer properties were provided against humidity change without toner scattering, the backside contamination of the transfer material and the deterioration of the image quality A further embodiment of the transfer roller will be described. The core metal and the conductive elastic layer were the same as in the foregoing embodiments. As for the semiconductive coating layer, use was made with a paint produced by solving polyurethane (trade name: E185, available from Nihon Miracron) in a solving of a mixture of DMF (dimethylformamide), toluene and MEK (methyl ethyl ketone)(solid content of 20%) and by adding thereinto 1% by weight of conductive carbon black (trade name: Ketjen 600JD (available from Lion Akzo), and by uniformly dispersing then with sandgrinder. The paint was applied on the EPDM elastic layer by dipping. It was dried at 120° C. for 20 min. to be formed into a coating layer of approximately 20 microns thickness. The volume resistivity of the coating layer was $1\times10^9$ ohm.cm under the normal temperature and normal humidity condition. The variation ratio k thereof was approximately 4.0, but the variation ratio of the entirety of the roller was approximately 0.35 (=k). The image transfer properties were stabilized against the humidity change without toner scattering, backside contamination of the transfer material and deterioration of the image quality.

The foregoing embodiments, the elastic layer is of EPDM sponge since then the hardness of the transfer roller is low enough to prevent the local non-transfer of a line image. For this purpose, the hardness of the transfer roller is preferably less than 35 degrees in Asker-C. On the other hand, if the hardness of the transfer roller is too low, the improper transfer occurs, and from this standpoint, the hardness is preferably not less than 20 degrees in Asker-C.

In the foregoing embodiments, the transfer roller has two layers outside the core metal. It may be of three or more layer structure. For example, it is a possible modification that a urethane rubber layer is provided between the core metal and the elastic layer, the rubber layer having the volume resistivity of $10^3$ or less ohm.cm A transfer roller (transfer member) is not necessary contacted to the photosensitive member. A clearance may be provided between the transfer roller and the photosensitive member, the clearance being smaller than the thickness of the transfer material As described in the foregoing, according to the present invention, irrespective of the ambient humidity, the images can be provided with the toner scattering and the backside contamination of the transfer material. In addition, the resistance change of the entire transfer roller can be maintained small, the limitation of the selection of the coating layer is reduced with the advantage of easier manufacturing together with the lost cost.

Furthermore, the EPDM of the elastic layer is not required to be subjected to modification treatment for the purpose of improving the durability against humidity, and therefore, the original properties of the EPDM are advantageously used. This stabilizes the production of the transfer roller together with the advantage of low cost.

Additionally, even when the transfer material is dry paper, good transfer properties can be provided without white dots in a solid black or halftone image.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

image transfer charging means for transferring a toner image from said image bearing member onto a transfer material, said transfer charging means having a transfer member contactable to a backside of the transfer material;

wherein said transfer member includes a conductive base, an elastic layer outside said conductive base, and a surface layer outside said elastic layer, satisfying:

$$5\times10^7 \leqq R_2 \leqq 5\times10^{10} \text{ (ohm.cm), and}$$

$$R_1d_1/R_2d_2 \geqq 10$$

where $R_1$ is a volume resistivity of said elastic layer (ohm.cm); $d_1$ is a thickness thereof (cm); $R_2$ is a volume resistivity of said surface layer (ohm.cm); and $d_2$ is a thickness thereof; and wherein a resistance of said surface layer and a resistance of said elastic layer vary in accordance with a change in ambient condition and a resistance variation of said surface layer is larger than a resistance variation of said elastic layer.

2. An apparatus according to claim 1, wherein said elastic layer is of foamed material.

3. An apparatus according to claim 1, wherein said transfer member is contactable to said image bearing member.

4. An apparatus according to claim 1, wherein said transfer charging means includes means for applying a voltage to said transfer member.

5. An apparatus according to claim 4, wherein said voltage application means applies to said transfer member a voltage for transferring the toner from said transfer member to said image bearing member when the transfer material is not present at an image transfer position.

6. An apparatus according to claim 4 or 5, wherein said voltage applying means applies to the transfer member a voltage of the same polarity as the charging polarity of the toner on said image bearing member, when the transfer material is not present at the transfer position

7. An apparatus according to claim 1 or 3, wherein said transfer member is in the form of a roller.

8. An apparatus according to claim 1, wherein said surface layer is of resin material.

9. An apparatus according to claim 8, wherein said surface layer is of polyurethane resin material.

10. An apparatus according to claim 1, wherein the volume resistivity $R_1$ satisfies:

$$5\times10^{10}\leqq R_1\leqq5\times10^{13}\ \text{(ohm.cm)}$$

11. An apparatus according to claim 1, 2 or 10, wherein $R_L/R_H\leqq10$, where $R_H$ is a resistance of said transfer member under high temperature (32.5° C.) and high humidity (90%relative humidity) condition; and $R_L$ is a resistance thereof under low temperature (15° C.) and low humidity (10% relative humidity) condition.

12. An apparatus according to claims, 1, 2, 8, 9 or 10, wherein said elastic layer comprises EPDM as a major component.

13. An apparatus according to claim 1, wherein said surface layer exhibits a resistance variation larger than a resistance variation of said elastic layer, when the ambient condition changes from high temperature (32.5° C.) and high humidity (90% relative humidity) to low temperature (15° C.) and low humidity (10% relative humidity).

14. An apparatus according to claim 1, wherein $d_2<d_1$.

* * * * *

UNITED STATES PATENT AND TRADEMARK OFFICE

CERTIFICATE OF CORRECTION

PATENT NO. : 5,150,165

DATED : September 22, 1992

INVENTOR(S) : Jun Asai

It is certified that error appears in the above-identified patent and that said Letters Patent is hereby corrected as shown below:

ON THE TITLE PAGE

Under [56] References Cited, U.S. Patent Documents, "Blazak" should read --Blaszak--, "5,098,851" should read --5,089,851, and "4,039,803" should read --4,309,803--.

Under [56] References Cited, Attorney, Agent or Firm, "Cella" should read --Cella,--.

Under [57] Abstract, "eleastic" should read --elastic-- and "$r_1$" should read --$R_1$--.

COLUMN 1

Line 43, "humidity" should read --humidity.--; and
Line 68, "cm" should read --cm.--.

COLUMN 2

Line 47, "means)" should read --means).--;
Line 50, "detail" should read --detail.--;
Line 53, "position" should read --position.--; and
Line 62, "position" should read --position.--.

COLUMN 4

Line 15, "invention" should read --invention.--.

UNITED STATES PATENT AND TRADEMARK OFFICE

CERTIFICATE OF CORRECTION

PATENT NO. : 5,150,165

DATED : September 22, 1992

INVENTOR(S) : Jun Asai

It is certified that error appears in the above-identified patent and that said Letters Patent is hereby corrected as shown below:

COLUMN 5

Line 36, "weak." should read --week.--.

COLUMN 6

Line 34, "produced" should read --produced.--; and
Line 66, "surface" should read --surface.--.

COLUMN 8

Line 6, "$R_1d_1/R_2/d_2 \geq 10$" should read
--$R_1d_1/R_2d_2 \geq 10$--;
Line 39, "wit" should read --with--; and
Line 57, "extruction" should read --extruction.--.

UNITED STATES PATENT AND TRADEMARK OFFICE

CERTIFICATE OF CORRECTION

PATENT NO. : 5,150,165

DATED : September 22, 1992

INVENTOR(S) : Jun Asai

It is certified that error appears in the above-identified patent and that said Letters Patent is hereby corrected as shown below:

COLUMN 9

Line 3, "embodiments" should read --embodiments.--; and
Line 29, "600JD (available" should read --600JD, available--.

Signed and Sealed this

Second Day of November, 1993

Bruce Lehman

BRUCE LEHMAN

*Commissioner of Patents and Trademarks*

*Attest:*

*Attesting Officer*